US008130169B2

(12) United States Patent
Chou et al.

(10) Patent No.: US 8,130,169 B2
(45) Date of Patent: Mar. 6, 2012

(54) MULTI-INPUT MULTI-OUTPUT ANTENNA SYSTEM

(75) Inventors: Jui-Hung Chou, Taichung (TW); Saou-Wen Su, Taipei (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 324 days.

(21) Appl. No.: 12/476,492

(22) Filed: Jun. 2, 2009

(65) Prior Publication Data

US 2009/0309806 A1 Dec. 17, 2009

(30) Foreign Application Priority Data

Jun. 13, 2008 (CN) ..... 2008 1 0028815

(51) Int. Cl.
*H01Q 1/00* (2006.01)

(52) U.S. Cl. ..... 343/905

(58) Field of Classification Search ..... 343/700 MS, 343/702, 795, 830, 846, 841, 905
See application file for complete search history.

(56) References Cited

U.S. PATENT DOCUMENTS

| | | | | |
|---|---|---|---|---|
| 6,624,789 | B1 * | 9/2003 | Kangasvieri et al. | 343/702 |
| 7,289,068 | B2 * | 10/2007 | Fujio et al. | 343/700 MS |
| 7,535,422 | B2 * | 5/2009 | Liu et al. | 343/702 |
| 7,579,991 | B2 * | 8/2009 | Mitsui | 343/700 MS |
| 7,808,438 | B2 * | 10/2010 | Schlub et al. | 343/702 |
| 7,898,485 | B2 * | 3/2011 | Schlub et al. | 343/702 |
| 7,928,923 | B2 * | 4/2011 | Udagawa et al. | 343/841 |
| 2009/0153404 | A1 * | 6/2009 | Ryou et al. | 343/700 MS |

* cited by examiner

*Primary Examiner* — Huedung Mancuso
(74) *Attorney, Agent, or Firm* — Li & Cai Intellectual Property (USA) Office

(57) ABSTRACT

A multi-input and multi-output antenna system is disclosed. The antenna system includes a predetermined quantity of dual-feed and dual-band antennas that are arranged into a polygon on a plane. The dual-feed and dual-band antenna includes a substrate, a grounding unit disposed on the substrate and having two opposite sides, a first radiating unit disposed on the substrate near one side of the grounding unit, and a second radiating unit disposed on the substrate near the other side. The second radiating unit has a shorting element that is electrically connected to the grounding unit. The polygon is bounded by lengthwise projection lines of the dual-feed and dual-band antennas.

20 Claims, 5 Drawing Sheets

MULTI-INPUT MULTI-OUTPUT ANTENNA SYSTEM

BACKGROUND OF THE INVENTION

1. Field of the Invention

The present invention relates to an antenna structure, in particular, to a multi-input multi-output antenna system capable of covering several wireless local area network frequency bands.

2. Description of Related Art

For various wireless communications devices and products, an antenna is a necessary and indispensable component, which functions as a major component for determining whether or not a communications product can receive radio waves successfully. As wireless communications products and consumer electronic products become more diversified, the design requirements for an antenna also become increasingly higher, so that the design requirement for the antenna must consider the receiving/transmitting performance along with the aesthetic style of the design results, and furthermore, the antenna design must also satisfy the electromagnetic wave characteristics of different wireless communications technologies. The end results are that the antenna technology keeps broadening the bandwidth and minimizing the size of the antenna.

As the wireless communications technology blooms, the demand for antennas increases drastically, and related applications in the areas of mobile phones, notebook computers, global positioning systems, and digital televisions currently rely on antennas for transmitting and receiving signals. The antenna is a necessary device for wireless communications devices and products to communicate with the outside world, since it is responsible for transmitting and receiving wireless signals. As an important component of a radio frequency system, the antenna has a substantial effect on the signal receiving quality and the overall performance of the wireless communications system. Therefore, since the user requirements are becoming higher in regard to stylish design, power saving function, transmission rate, and transmission range, and due to the fact that applications in different geographical areas have different requirements for the antennas, the design of antennas is becoming a more server technical challenge.

Most wireless local area network or 802.11a/b/g/n access-point antennas come with an external antenna structure. The most common antenna is a dipole antenna wrapped with plastic/rubber sleeves, and an antenna system of this sort is generally composed of a single frequency of 2.4 GHz or a dual frequency of 2.4/5 GHz; wherein the height of such antenna system is generally triple the thickness of the wireless broadband router/hub device, and the antenna is protruding and rises from the top of a casing of the device. However, the additional plastic/rubber sleeves connected to the periphery of the antenna incur a higher manufacturing cost and a higher level of difficulty for manufacturing the aforementioned antennas in terms of achieving mass production and assuring practical applications. Furthermore, the antenna is fixed by an external mechanical part for its operation, and the antenna of this sort cannot be built-in or hidden inside a general wireless broadband router/hub device, and thus the antenna is exposed to the outside from the casing, thereby substantially reducing the aesthetic appearance of the product. In addition, users need to install the antenna, and adjust the signal receiving position of the antenna before its use, and thus the operation is relatively inconvenient. The antenna also has the disadvantages of being damaged by external forces easily, occupying much space, and ruining an overall aesthetic appearance.

In view of the aforementioned shortcomings of the prior art, the inventor of the present invention discloses a reasonable and effective design to overcome the shortcomings of the prior art.

SUMMARY OF THE INVENTION

To achieve the above-mentioned objectives, the present invention provides a multi-input multi-output antenna system capable of producing several operating frequency bands to meet the requirements of multi-module applications.

Therefore, it is a primary objective of the present invention to provide a multi-input multi-output antenna system with the features of a simple structure and a compact size, so that the antenna system may be used extensively in wireless products.

To achieve the foregoing objective, the present invention provides a multi-input multi-output antenna system, comprising a predetermined quantity of dual-feed and dual-band antennas, each including: a substrate; a grounding unit disposed on the substrate and having two opposite sides; a first radiating unit, disposed on the substrate near one side of the grounding unit, and a second radiating unit disposed on the substrate near the other side of the grounding unit. The second radiating unit has a shorting element that is electrically connected to the grounding unit, wherein the predetermined quantity of the dual-feed and dual-band antennas are arranged into a polygon on a plane, and the polygon is bounded by lengthwise projection lines of the dual-feed and dual-band antennas.

The predetermined quantity of the dual-feed and dual-band antennas is a natural number greater than 2, and the dual-feed and dual-band antennas are arranged into the polygon having an included angle from 30 degrees to 150 degrees between the two adjacent dual-feed and dual-band antennas installed on the two adjacent sides of the polygon.

Preferably, the polygon is a regular polygon, and each dual-feed and dual-band antenna is situated at a mid-point of each side of the regular polygon. The lengthwise projection line of the dual-feed and dual-band antenna passes through the first radiating unit and the second radiating unit, and the predetermined quantity of the dual-feed and dual-band antennas are arranged on the sides of the polygon, and a first radiating unit of one dual-feed and dual-band antenna is adjacent to a second radiating unit of the next dual-feed and dual-band antenna.

Each dual-feed and dual-band antenna further includes a first coaxial transmission line coupled to the first radiating unit and the grounding unit; and a second coaxial transmission line coupled to the second radiating unit and the grounding unit. The first radiating unit and the second radiating unit respectively include a first feed point and a second feed point. The grounding unit includes a first grounding point on one side and a second grounding point on another side. The first coaxial transmission line includes a center conductor that is connected to the first feed point and an outer grounding conductor that is connected to the first grounding point; similarly, the second coaxial transmission line includes a center conductor that is connected to the second feed point and an outer grounding conductor that is connected to the second grounding point.

The second radiating unit and the shorting element both have at least one bend, and the first radiating unit has at least one slit.

The present invention also provides a multi-input multi-output antenna system, which includes a predetermined quantity of the dual-feed and dual-band antennas, and each dual-feed and dual-band antenna includes: a substrate, having a top surface and a bottom surface; a grounding unit, selectively formed at the top surface or the bottom surface of the substrate, and the grounding unit has two opposite sides; a first radiating unit, selectively formed at the top surface or the bottom surface of the substrate and disposed on a position corresponding to one side of the grounding unit; and a second radiating unit, selectively formed at the top surface or the bottom surface of the substrate and disposed on a position corresponding to another side of the grounding unit, wherein the second radiating unit includes a shorting element that is electrically connected to the grounding unit. The predetermined quantity of the dual-feed and dual-band antennas are arranged into a polygon on a plane, and a lengthwise projection line of each dual-feed and dual-band antenna constitute a side of the polygon.

The present invention has the following advantages: the present invention adopts a dual-feed and dual-band antenna having a small grounding surface to meet the radiation requirements of the antenna, so as to greatly reduce the dimensions of the antenna, and thereby satisfy the requirements of the dual-feed dual-band antenna operating in the two frequency bands and achieving good isolation. Therefore, the multi-input multi-output antenna system having the dual-feed and dual-band antenna also has the features of a simple structure and a small volume, and the antenna can be built in a wireless product without the need of being wrapped by a plastic sleeve, so as to achieve the effects of simplifying the antenna system, reducing costs, and providing an aesthetic appearance. In addition, a symmetric structure of a regular polygon formed and bounded by a plurality of the dual-feed and dual-band antennas provides good radiation performance and a wide coverage of receiving signals.

In order to further understand the techniques, means, and effects that the present invention takes for achieving the prescribed objectives, the following detailed descriptions and appended drawings are hereby referred, through which the purposes, features, and aspects of the present invention can be thoroughly and concretely appreciated; however, the appended drawings are merely provided for reference and illustration, without any intention to be used for limiting the present invention.

DETAILED DESCRIPTION OF THE PREFERRED EMBODIMENTS

Figure 1:
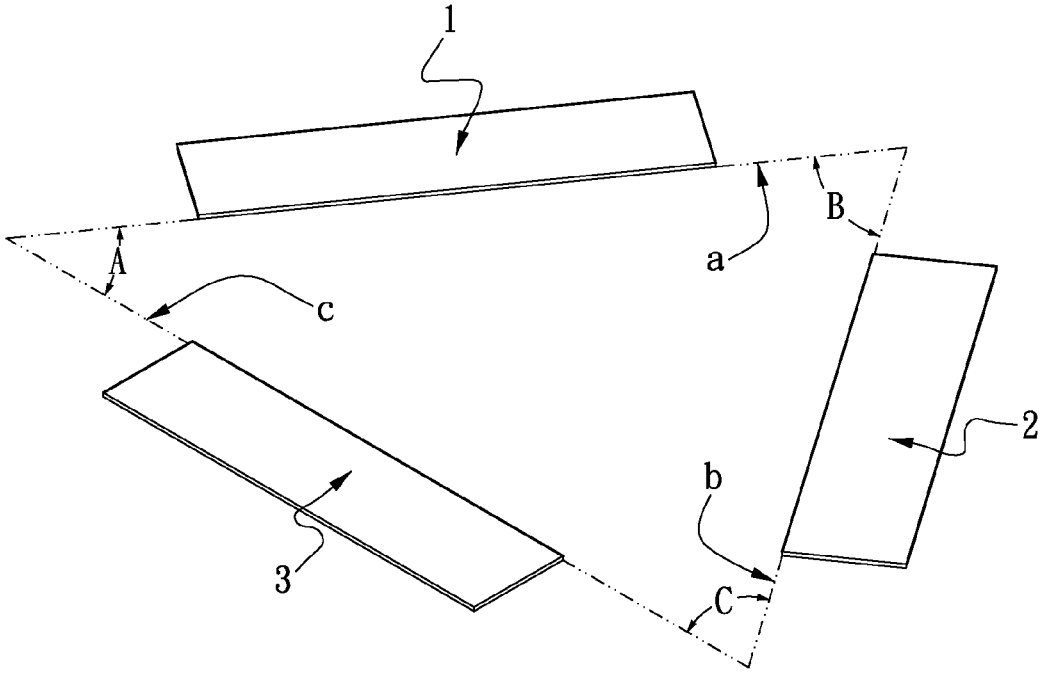
FIG. 1 is a schematic view of a structure of a multi-input multi-output antenna system in accordance with a first preferred embodiment of the present invention.

With reference to FIG. 1 for a multi-input multi-output antenna system in accordance with a preferred embodiment of the present invention, the multi-input multi-output antenna system includes three dual-feed and dual-band antennas 1, 2, 3 arranged into a triangle on a plane, and more specifically a lengthwise projection line a extends along a long side of the dual-feed and dual-band antenna 1, a lengthwise projection line b extends along a long side of the dual-feed and dual-band antenna 2, and a lengthwise projection line c extends along a long side of the dual-feed and dual-band antenna 3. Therein the three lengthwise projection lines a, b, and c constitute three sides of the triangle, and the included angle between a and c is equal to A, the included angle between a and b is equal to B, and the included angle of b and c is equal to C. Angles A, B, C are greater than 0 degree and smaller than 180 degrees, and preferably greater than 30 degrees and smaller than 150 degrees. Ideally, the triangle is a regular triangle, whose three sides a, b, c have an equal length, and three angles A, B, C are equal to 60 degrees. Most preferably, the dual-feed and dual-band antenna 1 is situated at a mid-point of the lengthwise projection line a. That is, the distance from an end of the dual-feed and dual-band antenna 1 to a vertex A is equal to the distance from another end of the dual-feed and dual-band antenna 1 to the vertex B. Similarly, the dual-feed and dual-band antenna 2 is situated at a mid-point of the lengthwise projection line b. That is, the distance from an end of the dual-feed and dual-band antenna 2 to a vertex B is equal to the distance from another end of the dual-feed and dual-band antenna 2 to the vertex C. Also similarly, the dual-feed and dual-band antenna 3 is situated at a mid-point of the lengthwise projection line c. That is, the distance from an end of the dual-feed and dual-band antenna 3 to a vertex C is equal to the distance from another end of the dual-feed and dual-band antenna 3 to the vertex A.

Figure 2:
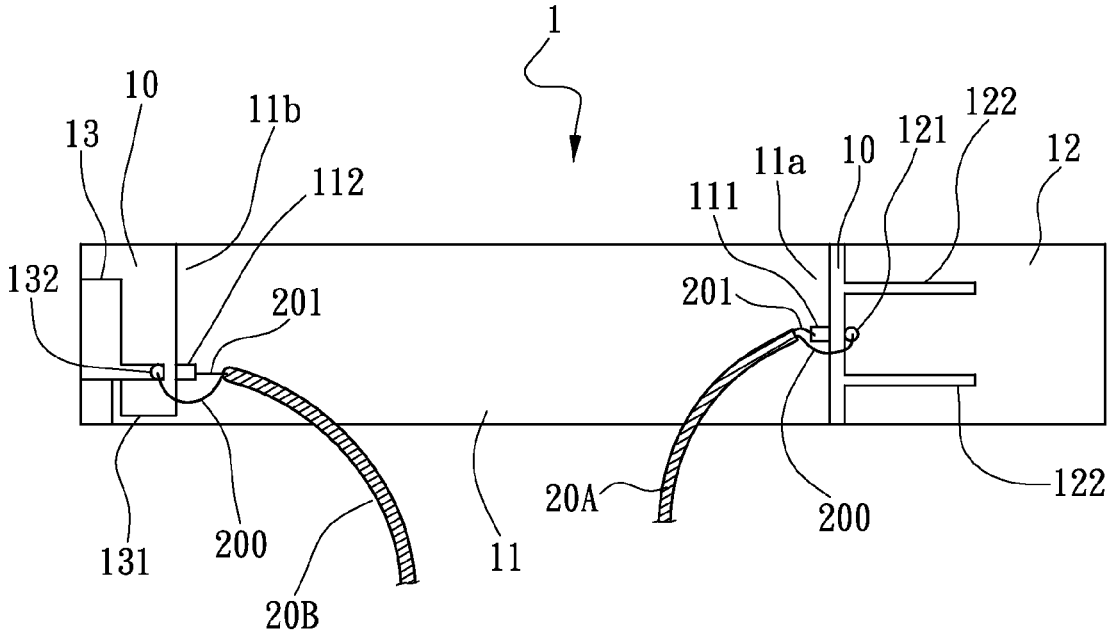
FIG. 2 is a top view of a structure of a dual-feed and dual-band antenna in accordance with the first preferred embodiment of the present invention.

With reference to FIG. 2 for a top view of a basic structure of a dual-feed and dual-band antenna in accordance with the first preferred embodiment of the present invention, the dual-feed and dual-band antenna 1 comprises: a substrate 10; a grounding unit 11, formed on the substrate 10 and the grounding unit 11 having two opposite sides 11*a* and 11*b*; a first radiating unit 12, formed on the substrate 10 and disposed on one side 11*a* of the grounding unit 11; a second radiating unit 13, formed on the substrate 10 and disposed on another side 11*b* of the grounding unit 11, wherein the side 11*a* and the other side 11*b* are disposed opposite to each other, and the second radiating unit 13 includes a shorting element 131 that is electrically connected to the grounding unit 11; a first coaxial transmission line 20A, coupled to the first radiating unit 12 and the grounding unit 11; and a second coaxial transmission line 20B, coupled to the second radiating unit 13 and the grounding unit 11; wherein the first radiating unit 12 and the second radiating unit 13 are used for providing a first frequency band and a second frequency band respectively, wherein the first frequency band and the second frequency band can be of different operating frequency bands or the same operating frequency band. In this preferred embodiment, the first frequency band and the second frequency band are two operating frequency bands such as 2.4 GHz of a wireless local area network and 5 GHz of a wireless local area network. Each of the related components is described in details as follows.

In FIG. 2, the first radiating unit 12 and the second radiating unit 13 are formed at the two opposite sides 11*a*, 11*b* of the grounding unit 11. There is no particular limitation on the shape of the grounding unit 11, and the grounding unit 11 can be a quadrilateral structure in the shape of a rectangle, a square, a parallelogram, or a rhombus, etc; or the grounding unit 11 can be a circular, elliptic, or polygonal structure. In this preferred embodiment, the structure used for illustrating the present invention is of the rectangular shape. In the FIG. 2, the first radiating unit 12 and the second radiating unit 13 are formed on two shorter sides 11*a*, 11*b* of the rectangle-shaped grounding unit 11. Preferably, the grounding surface of the grounding unit 11 is chosen within a range of 0.5 wavelength of the low-frequency band, provided that the antenna radiation function can be achieved. In other words, the first radiating unit 12 and the second radiating unit 13 can also be formed on the two longer sides of the rectangle-shaped grounding unit 11 as long as the antenna radiation function can be achieved. If the grounding unit 11 is in an elliptic shape, the first radiating unit 12 and the second radiating unit 13 can be formed on the two sides of the long axis of the elliptic shaped grounding unit 11 or on the two sides of the short axis of the elliptic shaped grounding unit 11. A predetermined axis passing through the center of the elliptic shaped grounding unit 11 or the circular shaped grounding unit 11 can be defined, provided that the first radiating unit 12 and the second radiating unit 13 that are disposed forms the two sides of the predetermined axis, and the grounding surface for controlling the grounding unit 11 preferably falls within a range smaller than 0.5 wavelength of the low-frequency band, in order to achieve the antenna radiation function.

In addition, the first radiating unit 12 includes a first feed point 121, and the grounding unit 11 includes a first grounding point 111, wherein the first grounding point 111 is disposed at the side 11*a*, and the first feed point 121 is disposed at a position corresponding to the first grounding point 111, and the first coaxial transmission line 20A is electrically connected to the first grounding point 111 and the first feed point 121. In FIG. 2, the first coaxial transmission line 20A includes a center conductor 200 and an outer grounding conductor 201, wherein the center conductor 200 is electrically connected to the first feed point 121, and the outer grounding conductor 201 is electrically connected to the first grounding point 111. Preferably, the first radiating unit 12 includes at least one slit 122, and the slits 122 further reduces the size of the dual-feed and dual-band antenna 1. In addition, the first radiating unit 12 is not limited to the rectangular shape as shown in FIG. 2, but can be in a circular shape, an elliptic shape, or another shape too.

In addition, the second radiating unit 13 is formed on another side 11*b* of the grounding unit 11, and the second radiating unit 13 includes a shorting element 131 that is electrically connected to the grounding unit 11, and the second radiating unit 13 further includes a second feed point 132, and the grounding unit 11 includes a second grounding point 112 disposed at a position corresponding to the second feed point 132. Similarly, the second coaxial transmission line 20B includes a center conductor 200 and an outer grounding conductor 201, wherein the center conductor 200 of the second coaxial transmission line 20B is electrically connected to the second feed point 132, and the outer grounding conductor 201 of the second coaxial transmission line 20B is electrically connected to the second grounding point 112. It is noteworthy to point out that both of the second radiating unit 13 and the shorting element 131 have at least one bend as shown in FIG. 2, and both of the second radiating unit 13 and the shorting element 131 have a bend to give an L-shaped appearance.

The grounding unit 11, the first radiating unit 12, and the second radiating unit 13 of the dual-feed and dual-band antenna 1 can be installed on different planes of the substrate 10, and thus the dual-feed and dual-band antenna 1 is a non-coplanar structure. In this preferred embodiment as shown in FIG. 10, the dual-feed and dual-band antenna 1 comprises: a substrate 10, having a top surface 10*a* and a bottom surface 10*b*; a grounding unit 11, selectively formed on the top surface 10*a* or the bottom surface 10*b* of the substrate 10, and having two opposite sides 11*a*, 11*b*; a first radiating unit 12, selectively formed on the top surface 10*a* or the bottom surface 10*b* of the substrate 10 and disposed on one side 11*a* of the grounding unit 11 or a position corresponding to the side 11*a* of the grounding unit 11; a second radiating unit 13, selectively formed on the top surface 10*a* or the bottom surface 10*b* of the substrate 10 and disposed on another side 11*b* of the grounding unit 11 or a position corresponding to the side 11*b* of the grounding unit 11, wherein the second radiating unit 13 includes a shorting element 131 that is electrically connected to the grounding unit 11 (as shown in FIG. 2); a first coaxial transmission line 20A, coupled to the first radiating unit 12 and the grounding unit 11; and a second coaxial transmission line 20B, coupled to the second radiating unit 13 and the grounding unit 11; wherein the first radiating unit 12 and the second radiating unit 13 are used for providing a first frequency band and a second frequency band respectively.

Figure 10:
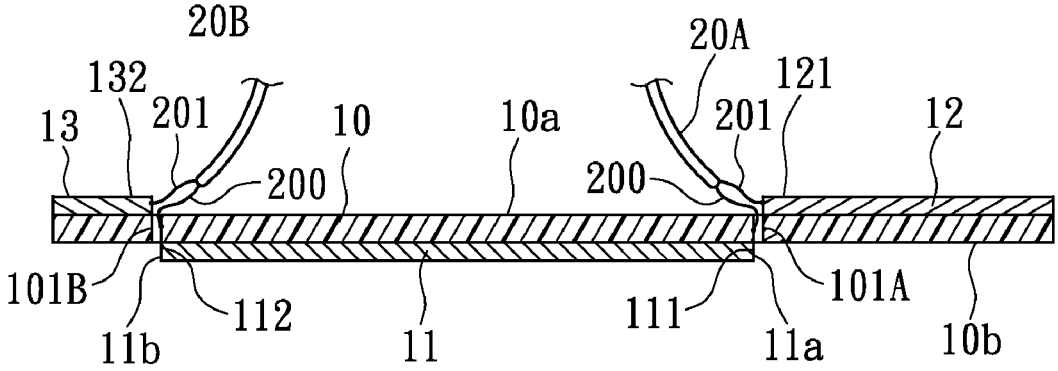
FIG. 10 is a cross sectional view of a structure of the dual-feed and dual-band antenna in a multi-input multi-output antenna system in accordance with another preferred embodiment of the present invention.

With reference to FIG. 10 for a dual-feed and dual-band antenna in accordance with another preferred embodiment of the present invention, the grounding unit 11 is formed on the bottom surface 10*b* of the substrate 10, and the first radiating unit 12 and the second radiating unit 13 are installed on the top surface 10*a* of the substrate 10. The substrate 10 preferably includes a first through hole 101A and a second through hole 101B, and either the center conductor 200 or the outer grounding conductor 201 of the first coaxial transmission line 20A is selectively passed through the first through hole 101A, so as to couple the first coaxial transmission line 20A to the first grounding point 111 and the first feed point 121; similarly, either the center conductor 200 or the outer grounding conductor 201 of the second coaxial transmission line 20B is selectively passed through the second through hole 101B, so as to couple the second coaxial transmission line 20B to the second feed point 132 and the second grounding point 112. Each of the aforementioned elements has the same characteristics of the aforementioned preferred embodiment, and thus will not be described here again. It is noteworthy to point out that FIG. 10 is provided for the purpose of illustration only, but not for limiting the scope of the present invention. In other words, the grounding unit 11, the first radiating unit 12, and the second radiating unit 13 can be installed on different sides of the substrate 10 according to the requirements of manufacturing processes or applications.

In FIG. 1, the dual-feed and dual-band antennas 1, 2, 3 can be of the same structure or different structures. Along the edges of the triangle formed by arranging the dual-feed and dual-band antennas 1, 2, 3, a first radiating unit of one dual-feed and dual-band antenna is disposed adjacent to a second radiating unit of another dual-feed and dual-band antenna. In other words, the first radiating unit of the dual-feed and dual-band antenna 1 is disposed adjacent to the second radiating unit of the dual-feed and dual-band antenna 2; the first radiating unit of the dual-feed and dual-band antenna 2 is disposed adjacent to the second radiating unit of the dual-feed and dual-band antenna 3; and the first radiating unit of the dual-feed and dual-band antenna 3 is disposed adjacent to the second radiating unit of the dual-feed and dual-band antenna 1.

The dual-feed and dual-band antenna mainly uses the first radiating unit 12 and the second radiating unit 13 to form a dual-band antenna for providing a first frequency band (such as a low-frequency band mode) and a second frequency band (such as a high-frequency band mode) respectively. The two frequency bands can cover a low frequency (such as 2400-2484 MHz) for indoor wireless local area networks and a high frequency (such as 5150-5875 MHz) for wideband wireless local area networks, and the shorting element 131 is adopted to achieve the effect of minimizing the size of the antenna.

The dual-feed and dual-band antenna does not require a large grounding surface to provide an antenna radiation function and the grounding surface of the grounding unit 11 preferably falls within a range smaller than 0.5 wavelength of the low-frequency band to achieve the antenna radiation function, and thus the overall volume of the antenna can be reduced. In addition, the dual-feed and dual-band antenna comes with a simple structure, is easy to manufacture, and is of low cost. The multi-input multi-output antenna system composed of several dual-feed and dual-band antennas can be installed into a casing of a wireless communications product conveniently without requiring the plastic/rubber sleeves anymore, and thus the present invention can achieve the effects of simplifying the manufacturing process, lowering the cost, and providing an aesthetic appearance.

Figure 3:
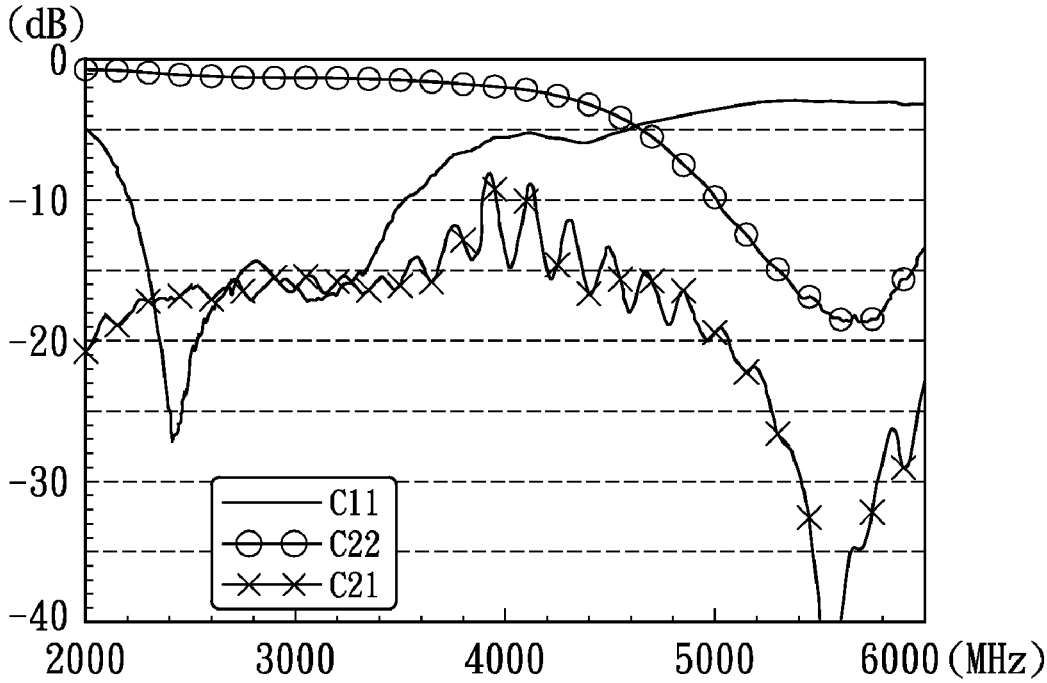
FIG. 3 is a graph of measured results of the dual-feed and dual-band antenna reflection coefficients and isolation in accordance with the first preferred embodiment of the present invention.

With reference to FIG. 3 for a graph of measured results of reflection coefficients and isolation of a dual-feed and dual-band antenna in accordance with a first preferred embodiment of the present invention, a curve C11 represents the performance of the dual-feed and dual-band antenna operating at a low frequency, and a curve C22 represents the performance of the dual-feed and dual-band antenna operating at a high frequency, and a curve C21 shows the isolation between these two frequencies. In general, the impedance bandwidth of an antenna below −10 dB can provide a better transmission quality as shown in FIG. 3, and the curve C11 of the dual-feed and dual-band antenna in accordance with this preferred embodiment satisfies the requirement of an impedance bandwidth below −10 dB in 2400-2484 MHz. Similarly, the curve C22 in 5150-5875 MHz also satisfies the condition of having an impedance bandwidth below −10 dB. On the other hand, the curve C21 at a high frequency or a low frequency is less than −15 dB, and thus a good isolation between the high and low frequencies is provided for preventing any interference between the two frequencies.

Figure 4:
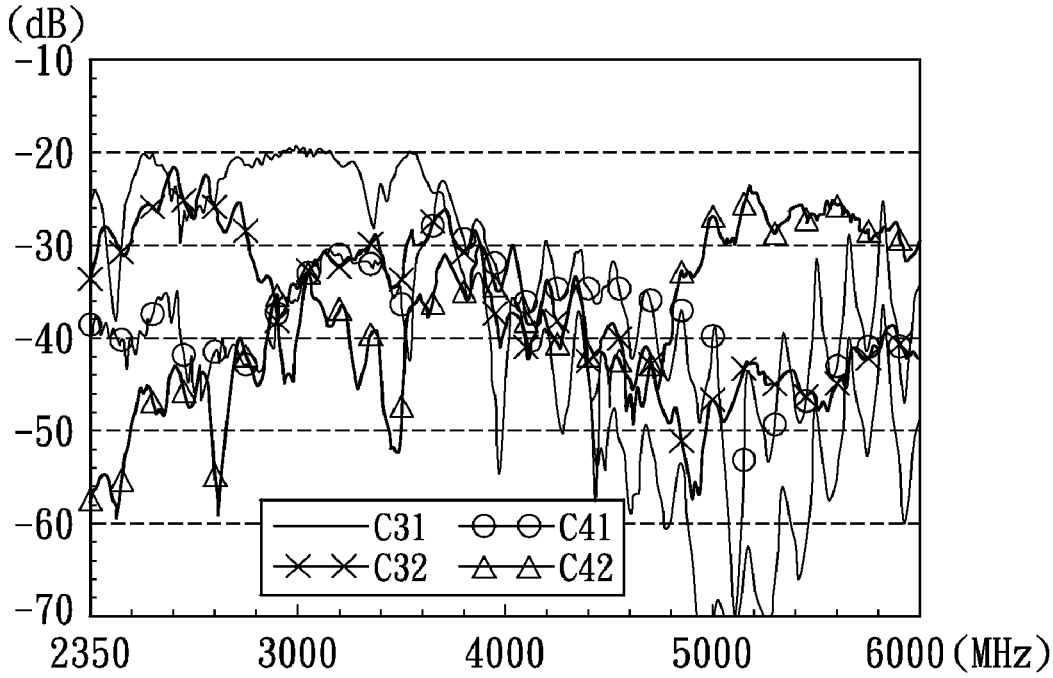
FIG. 4 is a graph of measured result of the dual-feed and dual-band antenna isolation in accordance with the first preferred embodiment of the present invention.

With reference to FIGS. 4 to 8 for experimental measurements of a multi-input multi-output antenna system of a preferred embodiment of the present invention, FIG. 4 is a graph of measured results of a dual-feed dual-band antenna in accordance with the first preferred embodiment. Since this embodiment includes three dual-feed and dual-band antennas arranged into a regular triangle as shown in FIG. 1, the measured results of isolation between any two adjacent dual-feed and dual-band antennas are the same. FIG. 4 shows the isolation between the first and second radiating units of a dual-feed and dual-band antennas and the second and first radiating unit of another one of the dual-feed and dual-band antenna. Specifically, two of the four curves show the isolation of a first radiating unit of a dual-feed and dual-band antenna respectively between a first radiating unit and a second radiating unit of another adjacent dual-feed and dual-band antenna; and the other two of the four curves show the isolation of a second radiating unit of the dual-feed and dual-band antenna respectively between a first radiating unit and a second radiating unit of another adjacent dual-feed and dual-band antenna. Regardless of the high frequency or the low frequency, the curves C31, C32, C41, C42 are below −20 dB, indicating that very good isolation exists respectively between the first radiating unit and the second radiating unit of the dual-feed and dual-band antenna and the second radiating unit and the first radiating unit of another adjacent dual-feed and dual-band antenna. Thereby the good isolation prevents any interference from occurring in the operation of the antenna.

Figure 5:
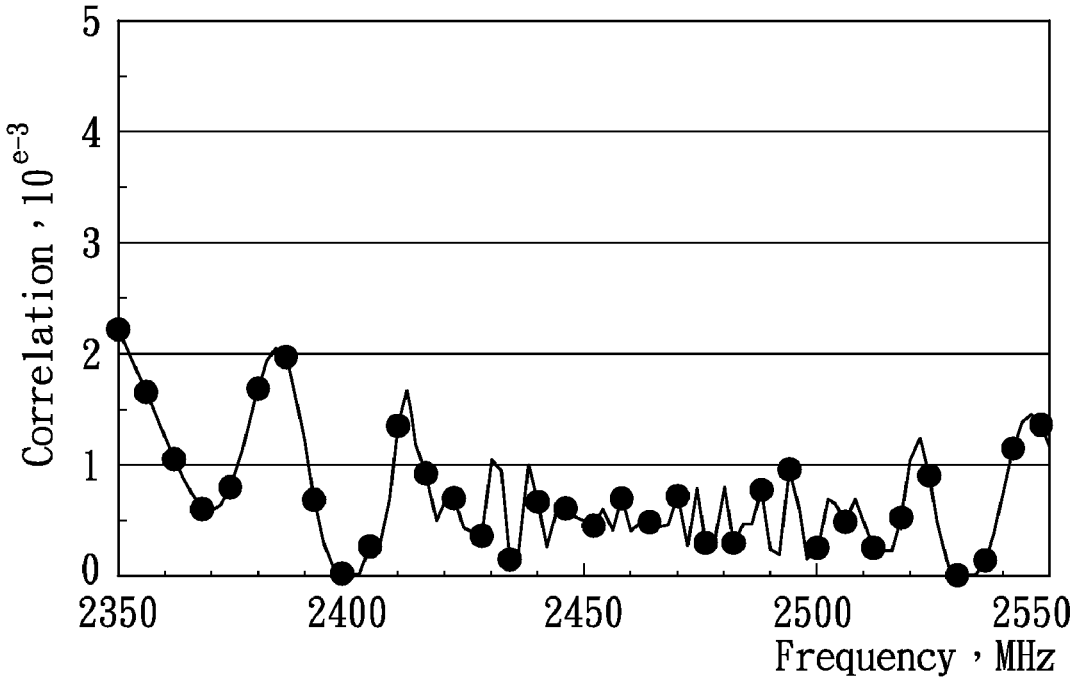
FIG. 5 is a graph of an envelop correlation of the multi-input multi-output antenna system operating at 2.4 GHz frequency in accordance with the first preferred embodiment of the present invention.

With reference to FIG. 5 for a graph of an envelop correlation analysis of the multi-input multi-output antenna system operating at 2.4 GHz frequency in accordance with the first preferred embodiment of the present invention, wherein a dual-feed and dual-band antenna has an independent property when the antenna system is operated at a low frequency. In general, the numerical value of the independent property is smaller than 0.3, indicating a very good independence of the actual operation of the antenna. In other words, the antennas will not interfere with each other.

Figure 6:
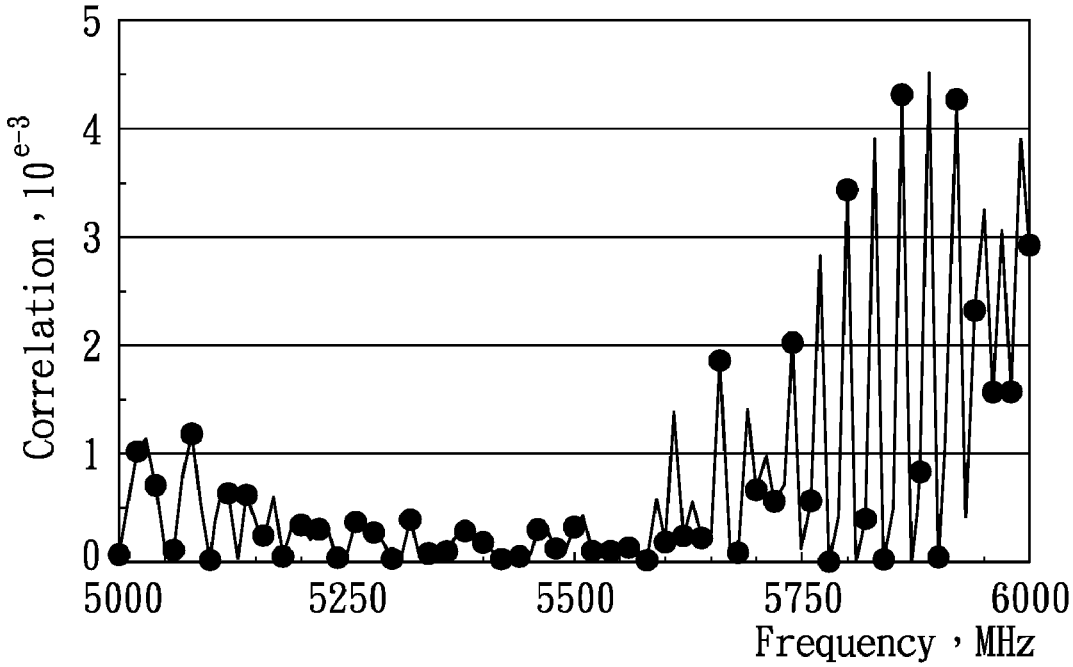
FIG. 6 is a graph of an envelop correlation graph of the multi-input multi-output antenna system operating at 5 GHz frequency in accordance with the first preferred embodiment of the present invention.

With reference to FIG. 6 for a graph of an envelop correlation graph of the multi-input multi-output antenna system operating at 5 GHz frequency in accordance with the first preferred embodiment of the present invention, a very good independence existed among the dual-feed and dual-band antennas can be achieved if the antenna system is operating at a high frequency, such that each antenna would not be affected by adjacent antennas.

Figure 7:
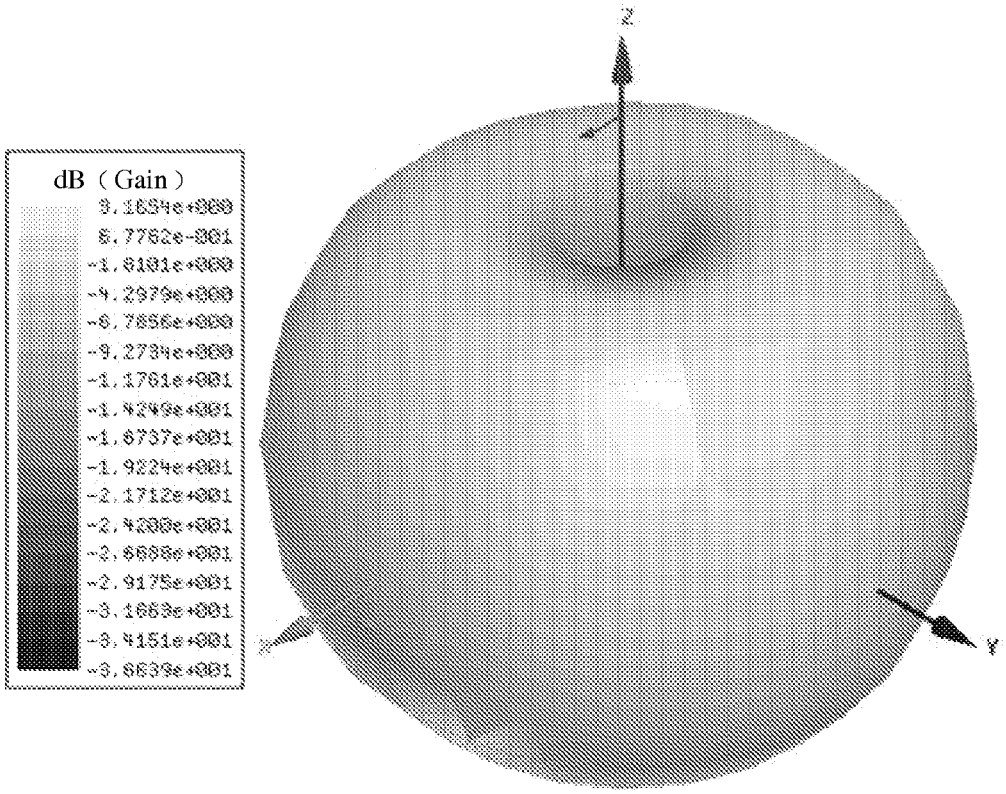
FIG. 7 is a schematic 3D diagram of radiation field of a low-frequency radiating unit of the multi-input multi-output antenna system excited at 2.442 GHz in accordance with the first preferred embodiment of the present invention.

With reference to FIG. 7 for a schematic 3D diagram of a radiation field of a low-frequency radiating unit of the multi-input multi-output antenna system excited at 2.442 GHz in accordance with the first preferred embodiment of the present invention, three dimensional (x-y-z) radiation field is omnidirectional radiation field that can meet the application requirements for the operation of a wireless local area network.

Figure 8:
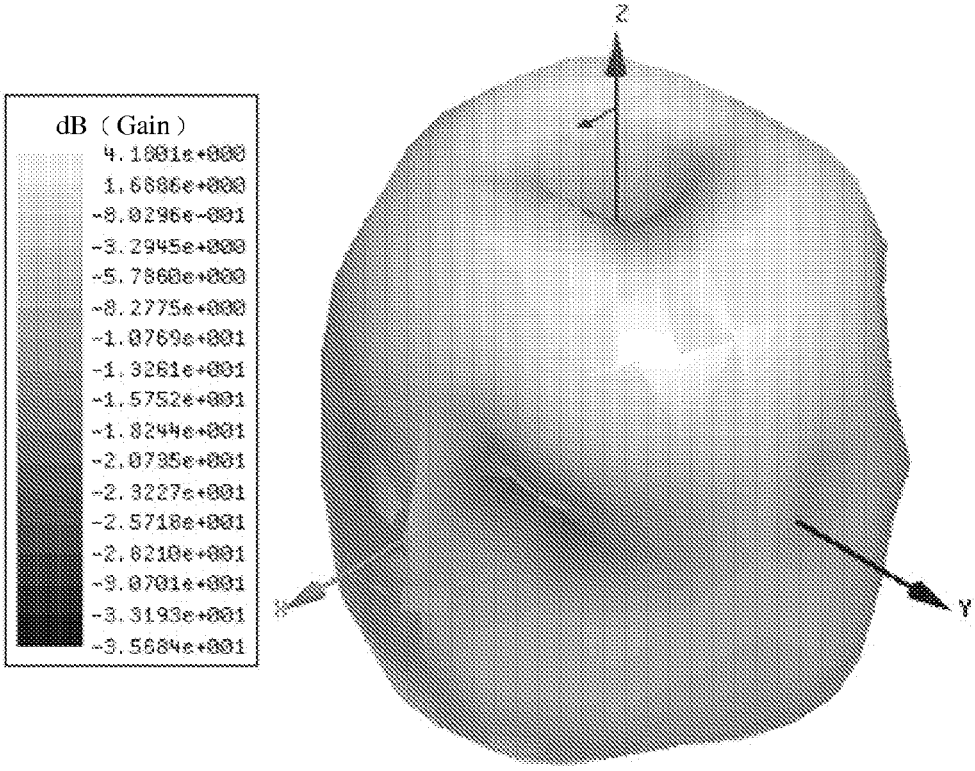
FIG. 8 is a schematic 3D diagram of radiation field of a high-frequency radiating unit of the multi-input multi-output antenna system excited at 5 GHz in accordance with the first preferred embodiment of the present invention.

With reference to FIG. 8 for a schematic 3D diagram of radiation field of a high-frequency radiating unit of the multi-input multi-output antenna system excited at 5 GHz in accordance with the first preferred embodiment of the present invention, three-dimensional (x-y-z) radiation field obtained thereby is omnidirectional radiation field that can meet the application requirements for the operation of a wireless local area network.

Figure 9:
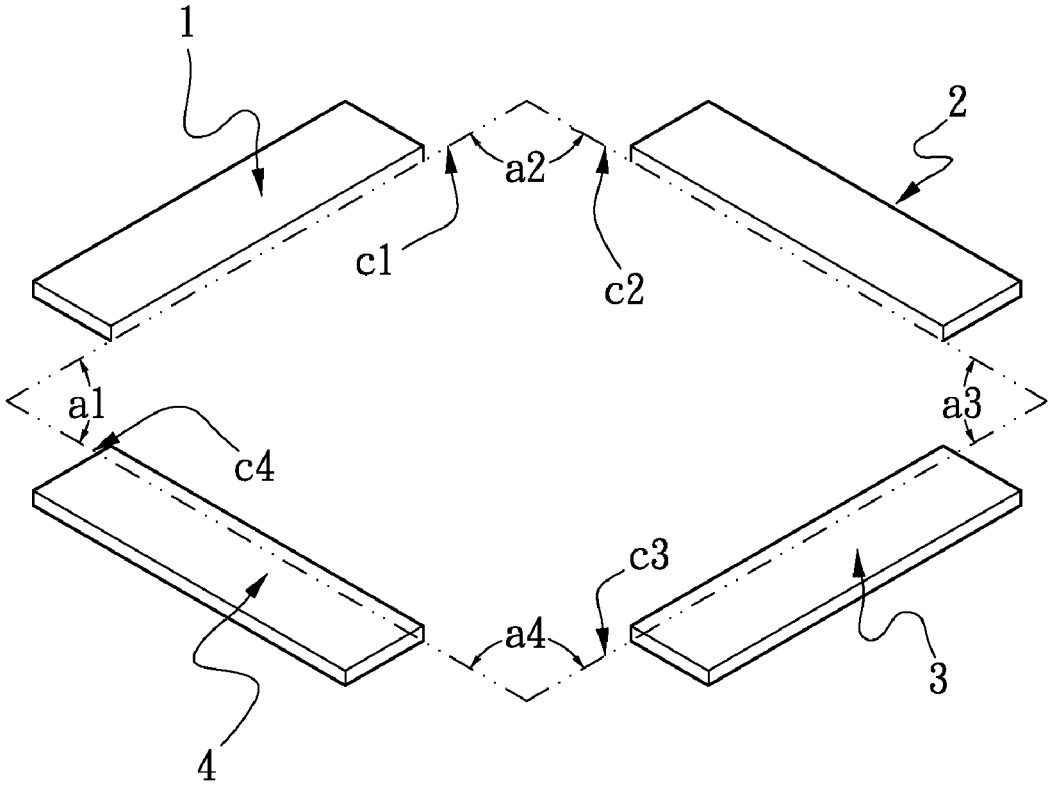
FIG. 9 is a schematic view of a structure of the multi-input multi-output antenna system in accordance with a second preferred embodiment of the present invention.

With reference to FIG. 9 for a schematic view of a structure of the multi-input multi-output antenna system in accordance with a second preferred embodiment of the present invention, the multi-input multi-output antenna system comprises four dual-feed and dual-band antennas 1, 2, 3, 4 arranged into a quadrilateral on a plane. More specifically, a lengthwise projection line c1 extends along a long side of the dual-feed and dual-band antenna 1, a lengthwise projection line c2 extends along a long side of the dual-feed and dual-band antenna 2, a lengthwise projection line c3 extends along a long side of the dual-feed and dual-band antenna 3, and a lengthwise projection line c4 extends along a long side of the dual-feed and dual-band antenna 4 to constitute four sides of the quadrilateral. In addition, an included angle between c1 and c4 is equal to a1, an included angle between c1 and c2 is equal to a2, an included angle between c2 and c3 is equal to a3, and an included angle between c3 and c4 is equal to a4. The angles a1, a2, a3, a4 are greater than zero degree and less than 180 degrees, and preferably greater than 30 degrees and smaller than 150 degrees. The quadrilateral is ideally a square, wherein c1, c2, c3, c4 are four sides with an equal length. The angles a1, a2, a3, a4 are all equal to 90 degrees. Preferably, the dual-feed and dual-band antenna 1 is situated at a mid-point of the side c1 or near the mid-point of the side c1, wherein the distance from an end of the dual-feed and dual-band antenna 1 to the vertex a1 is exactly or roughly equal to the distance from another end to the vertex a2. Similarly, the dual-feed and dual-band antenna 2 is situated at or near a mid-point of the side c2, and the dual-feed and dual-band antenna 3 is situated at or near a mid-point of the side c3, and the dual-feed and dual-band antenna 4 is situated at or near a mid-point of the side c4.

The quantity of dual-feed and dual-band antennas in the multi-input multi-output antenna system is a natural number not limited to 3, 4, 5 or 6 only, but several dual-feed and dual-band antennas can be arranged into a polygon on the same plane, similar to the first preferred embodiment or the second preferred embodiment.

In the design of the antenna of the present invention, a single dual-feed and dual-band antenna has the advantages of a simple structure, being easy to manufacture, and is of low cost. In practical applications, the antenna can be hidden within a casing of a wireless broadband router/hub. In addition, a single dual-feed and dual-band antenna further includes two antenna radiating units covering the frequency bands of 2.4 GHz and 5 GHz respectively, so as to save the cost of required circuits. In the present invention, two or more dual-feed and dual-band antennas are used to form the multi-input multi-output antenna system, and the antennas are maintained with isolation to provide good performance below −15 dB as well as enhancing the data access throughput to satisfy the requirements for an intensive audio/video multimedia data access via the wireless local area network /802.11a/b/g/n.

The above-mentioned descriptions represent merely the preferred embodiments of the present invention, without any intention to limit the scope of the present invention thereto. Various equivalent changes, alternations, or modifications based on the claims of the present invention are all consequently viewed as being embraced by the scope of the present invention.

What is claimed is:

1. A multi-input multi-output antenna system, comprising:

a plurality of dual-feed and dual-band antennas, each dual-feed and dual-band antenna comprising:

a substrate;

a grounding unit, formed on the substrate, and having two opposite sides;

a first radiating unit, formed on the substrate and disposed near one side of the grounding unit; and a second radiating unit, formed on the substrate and disposed near another side of the grounding unit, and the second radiating unit having a shorting element that is electrically connected to the grounding unit;

wherein the dual-feed and dual-band antennas are arranged into a polygon on a plane, and the polygon is bound by lengthwise projection lines of the dual-feed and dual-band antennas;

wherein the first radiating unit of one of the dual-feed and dual-band antennas disposed on a side of the polygon is situated adjacent to the second radiating unit of the adjacent dual-feed and dual-band antenna disposed on another side of the polygon.

2. The multi-input multi-output antenna system of claim 1, wherein the grounding unit is formed on a middle portion of the substrate, and the first and second radiating units are respectively formed on two opposite side portions of the substrate.

3. The multi-input multi-output antenna system of claim 1, wherein the polygon is a regular polygon, and each dual-feed and dual-band antenna is situated a mid-point of each side of the regular polygon.

4. The multi-input multi-output antenna system of claim 1, wherein the two adjacent dual-feed and dual-band antennas disposed at the two adjacent sides of the polygon form an included angle that is within a range from 30 degrees to 150 degrees.

5. The multi-input multi-output antenna system of claim 1, wherein each dual-feed and dual-band antenna further comprises a first coaxial transmission line coupled to the first radiating unit and the grounding unit; and a second coaxial transmission line coupled to the second radiating unit and the grounding unit.

6. The multi-input multi-output antenna system of claim 5, wherein the first radiating unit and the second radiating unit respectively has a first feed point and a second feed point; the grounding unit has a first grounding point disposed on one side and a second grounding point disposed on another side; the first coaxial transmission line has a center conductor that is coupled to the first feed point and an outer grounding conductor that is coupled to the first grounding point; and the second coaxial transmission line includes a center conductor that is coupled to the second feed point and an outer grounding conductor that is coupled to the second grounding point.

7. The multi-input multi-output antenna system of claim 1, wherein the second radiating unit and the shorting element have at least one bend each.

8. The multi-input multi-output antenna system of claim 1, wherein the first radiating unit has at least one slip.

9. The multi-input multi-output antenna system of claim 1, wherein the antenna system can be hidden within a casing of a wireless broadband router/hub.

10. A multi-input multi-output antenna system, comprising:

a plurality of dual-feed and dual-band antennas, each dual-feed and dual-band antenna comprising:

a substrate, having a top surface and a bottom surface;

a grounding unit, selectively formed on the top surface or the bottom surface of the substrate, and having two opposite sides;

a first radiating unit, selectively formed on the top surface or the bottom surface of the substrate, and disposed on a position corresponding to one side of the grounding unit; and a second radiating unit, selectively formed on the top surface or the bottom surface of the substrate, and disposed on a position corresponding to another side of the grounding unit, and the second radiating unit having a shorting element that is electrically connected to the grounding unit;

wherein the dual-feed and dual-band antennas are arranged into a polygon on a plane, and the polygon is bound by lengthwise projection lines of the dual-feed and dual-band antennas;

wherein the first radiating unit of one of the dual-feed and dual-band antennas disposed on a side of the polygon is situated adjacent to the second radiating unit of the adjacent dual-feed and dual-band antenna disposed on another side of the polygon.

11. The multi-input multi-output antenna system of claim 10, wherein the grounding unit is formed on a middle portion of the substrate, and the first and second radiating units are respectively formed on two opposite side portions of the substrate.

12. The multi-input multi-output antenna system of claim 10, wherein the polygon is a regular polygon, and each dual-feed and dual-band antenna is situated at a mid-point of each side of the regular polygon.

13. The multi-input multi-output antenna system of claim 10, wherein the two adjacent dual-feed and dual-band antennas disposed at the two adjacent sides of the polygon form an included angle that is within a range from 30 degrees to 150 degrees.

14. The multi-input multi-output antenna system of claim 10, wherein each dual-feed and dual-band antenna further includes a first coaxial transmission line coupled to the first radiating unit and the grounding unit; and a second coaxial transmission line coupled to the second radiating unit and the grounding unit.

15. The multi-input multi-output antenna system of claim 14, wherein the substrate further includes a first through hole and a second through hole.

16. The multi-input multi-output antenna system of claim 15, wherein the first radiating unit has a first feed point, and the grounding unit has a first grounding point disposed on one side; the second radiating unit has a second feed point, and the grounding unit has a second grounding pint disposed on the other side.

17. The multi-input multi-output antenna system of claim 16, wherein the first coaxial transmission line has a center conductor and an outer grounding conductor, and either the center conductor or the outer grounding conductor of the first coaxial transmission line is selectively passed through the first through hole for coupling the center conductor to the first feed point, and for coupling the outer grounding conductor to the first grounding point; the second coaxial transmission line has a center conductor and an outer grounding conductor, and either the center conductor or the outer grounding conductor of the second coaxial transmission line is selectively passed through the second through hole for coupling the center conductor to the second feed point, and for coupling the outer grounding conductor to the second grounding point.

18. The multi-input multi-output antenna system of claim 10, shorting element wherein the second radiating unit and the shorting element have at least one bend each.

19. The multi-input multi-output antenna system of claim 10, wherein the first radiating unit has at least one slip.

20. The multi-input multi-output antenna system of claim 10, wherein the antenna system can be hidden within a casing of a wireless broadband router/hub.

* * * * *